US006687468B2

(12) United States Patent
Holubek et al.

(10) Patent No.: US 6,687,468 B2
(45) Date of Patent: Feb. 3, 2004

(54) MULTI-POSITION FUSER NIP CAM

(75) Inventors: Paul J. Holubek, North Cohocton, NY (US); P. Michael Dooley, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/040,685

(22) Filed: Jan. 7, 2002

(65) Prior Publication Data

US 2003/0128994 A1 Jul. 10, 2003

(51) Int. Cl.[7] ..... G03G 15/20
(52) U.S. Cl. ..... 399/45; 219/216; 399/67
(58) Field of Search ..... 399/45, 67, 68, 399/320, 328; 219/216; 432/60

(56) References Cited

U.S. PATENT DOCUMENTS 4,119,831 A * 10/1978 Sato ..... 219/216
4,232,959 A * 11/1980 Ateya et al. ..... 219/216 X
4,719,489 A * 1/1988 Ohkubo et al. ..... 219/216 X
4,873,553 A * 10/1989 Inaba ..... 219/216 X
5,138,379 A * 8/1992 Kanazashi ..... 399/67 X
5,956,543 A * 9/1999 Aslam et al. ..... 399/45
6,201,938 B1 * 3/2001 Hollar et al. ..... 399/67

* cited by examiner

*Primary Examiner*—William J. Royer
(74) *Attorney, Agent, or Firm*—Perman & Green, LLP

(57) ABSTRACT

A roll fusing apparatus for effectively heating and fusing quality toner images on various different thicknesses of substrates is described. The apparatus includes a frame, a heated fuser roller having a first end and a second end respectively mounted to the frame; a pressure device mounted to the frame and forming a fusing nip with the heated fuser roller, the heated fuser roller and the pressure device being movable for receiving, heating and applying a nip force to toner images being moved through the fusing nip on various different thicknesses of substrates; a rotatable cam providing a varying amount of pressure to the pressure device in response to the thickness of the substrate being fed into the nip of the fusing apparatus; a drive shaft for rotating the cam; and a controller for selectively moving the cam in response to the thickness of the substrate.

7 Claims, 3 Drawing Sheets

MULTI-POSITION FUSER NIP CAM

BACKGROUND OF THE INVENTION

1. Field of the Invention

This invention relates generally to a copying or printing apparatus, and more particularly, it relates to the heat and pressure fixing of particulate thermoplastic toner by direct contact with a heated fusing member in a xerographic environment. Even more particularly this invention relates to a multi-position fuser cam to compensate for fuser nip pressure over a large range of paperweights.

The basic design of the multi-position fuser cam (lobe) in accordance with the embodiment described herein will help compensate fuser nip pressures over a large range of paperweights. Each cam position will yield a higher nip pressure, ideally not more than 0.4 mm nip increase per lobe. This will lessen the need to raise and lower fuser temperature and will allow higher throughput speeds. This will also increase fuser roll and belt life.

2. Description of Prior Developments

In the process of xerography, a light image of an original to be copied is typically recorded in the form of a latent electrostatic image upon a photosensitive member with subsequent rendering of the latent electrostatic image visible by the application of electroscopic marking particles, commonly referred to as toner. The visual toner image can be either fixed directly upon the photosensitive member or transferred from the photosensitive member to another support, such as a sheet of plain paper, with subsequent affixing of the toner image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and becomes tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is well known.

One approach to heat and pressure fusing of electroscopic toner images onto support members has been to pass the support members with the toner images thereon between a pair of opposed roller members, at least one of which is internally heated. During operation of a fusing system of this type, the support members to which the toner images are electrostatically adhered are moved through a nip formed between the roller members with the toner images contacting a fuser roll thereby to effect heating of the toner images within the nip.

Belt fusers are known in the prior art. For example, U.S. Pat. Nos. 4,563,073 and 4,565,439 each disclose a heat and pressure fusing apparatus for fixing toner images. The fusing apparatus is characterized by the separation of the heat and pressure functions such that the heat and pressure functions are effected at different locations on a thin flexible belt forming a toner contacting surface. A pressure roll cooperates with a stationary mandrel to form a nip through which the belt and a copy substrate pass simultaneously. The belt is heated such that by the time it passes through the nip its temperature together with an applied pressure is sufficient for fusing the toner images passing therethrough.

Especially with the introduction of color copying or color printing apparatus, issues have been raised within the fusing areas due to the use of different types and thickness of paper stock. Current methods used for heavy-weight paper stock in such process or apparatus is to adjust the temperature of the fuser and/or slow the speed of the fuser in a downward direction. The problems raised with this procedure is that the process does not take into account the thickness of the paper stock which has a proportional effect on a fuser nip. This in turn causes the paper stock to ripple which prevents the paper stock from tacking properly which in turn causes deletion problems when duplexing.

Current designs for a fuser assembly especially useful for accommodating heavier papers, seem to be favoring increasing the fusing temperature and/or slowing the paper speed through the fuser assembly. However, slowing the speed takes away from overall productivity, and additional heat has a negative effect on soft roll life. A multi-lobed cam concept in accordance with the features of the present invention could be used in conjunction with current fuser assembly designs to enhance fusing characteristics, or in some cases even replace current fuser assembly designs. The invention as described herein offers several benefits over current fuser assemblies, i.e., increased throughput speeds, wider latitude of materials, longer fuser roll life, and overall improvement in the condition of output pages by further minimizing curl and/or wrinkling.

SUMMARY OF THE INVENTION

According to the features of the embodiments described herein, the above described disadvantages found within a fuser environment are avoided including the avoidance of overheating of the paper, by using a roll fusing apparatus for effectively heating and fusing quality toner images on various different thicknesses of substrates including a frame; a heated fuser roller having a first end and a second end respectively mounted to the frame; a pressure means mounted to the frame and forming a fusing nip with the heated fuser roller, the heated fuser roller and the pressure means being movable for receiving, heating and applying a nip force to toner images being moved through the fusing nip on various different thicknesses of substrates; a rotatable cam providing a varying amount of pressure to the pressure means in response to the thickness of the substrate being fed into the nip of the fusing apparatus; means for rotating the cam; and control means for selectively moving the cam in response to the thickness of the substrate.

Included within the scope of the features of the present invention which have overcome the disadvantages of the prior art are an electrostatographic reproduction machine including a movable image bearing member having an image bearing surface defining a path of movement therefor; electrostatographic devices mounted along the path of movement for forming and transferring toner images onto various different types of substrates; and a roll fusing apparatus for effectively heating and fusing the toner images on various different thicknesses of substrates, the roll fusing apparatus including: (i) a frame; (ii) a heated fuser roller having a first end and a second end respectively mounted to said frame; (iii) a pressure means mounted to said frame and forming a fusing nip with the heated fuser roller, the heated fuser roller and the pressure means being movable for receiving, heating and applying a nip force to toner images being moved through the fusing nip on various different thicknesses of substrates; (iv) a rotatable cam providing a varying amount of pressure to the pressure means in response to the thickness of the substrate being fed into the nip of the fusing apparatus; (v) means for rotating the cam; and (vi) control means for selectively moving the cam in response to the thickness of the substrate.

BRIEF DESCRIPTION OF THE DRAWINGS

The accompanying drawings, which are incorporated in and constitute a part of the specification illustrate one embodiment of the invention and, together with the description herein, serve to explain the principles of the invention.

While the present invention will be described hereinafter in connection with preferred embodiments thereof, it should be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT(S)

For a general understanding of the features of the present invention, reference is made to the drawings. The following description illustrates the path that a belt photoreceptor follows in a color electrophotographic printing machine, and presents one example of the type of environment which the roll fusing apparatus of the present invention can be used. The primary difference between an electrophotographic printer and electrophotographic copier employing the fusing apparatus having the features of the present invention is that in the case of a printer a user will provide input to the printer relating to the thickness of the paper (substrate material) being printed upon by directing a computer with an appropriate input to the printer whereas in the case of the copier, it will be the user who provides the necessary input to the cotliers regarding paper thickness.

It will also become evident from the following discussion that the present invention is equally well suited for use in a wide variety of printing systems, and is not necessarily limited in its application to the particular xerographic printing system illustrated and described herein as an example.

Figure 1:
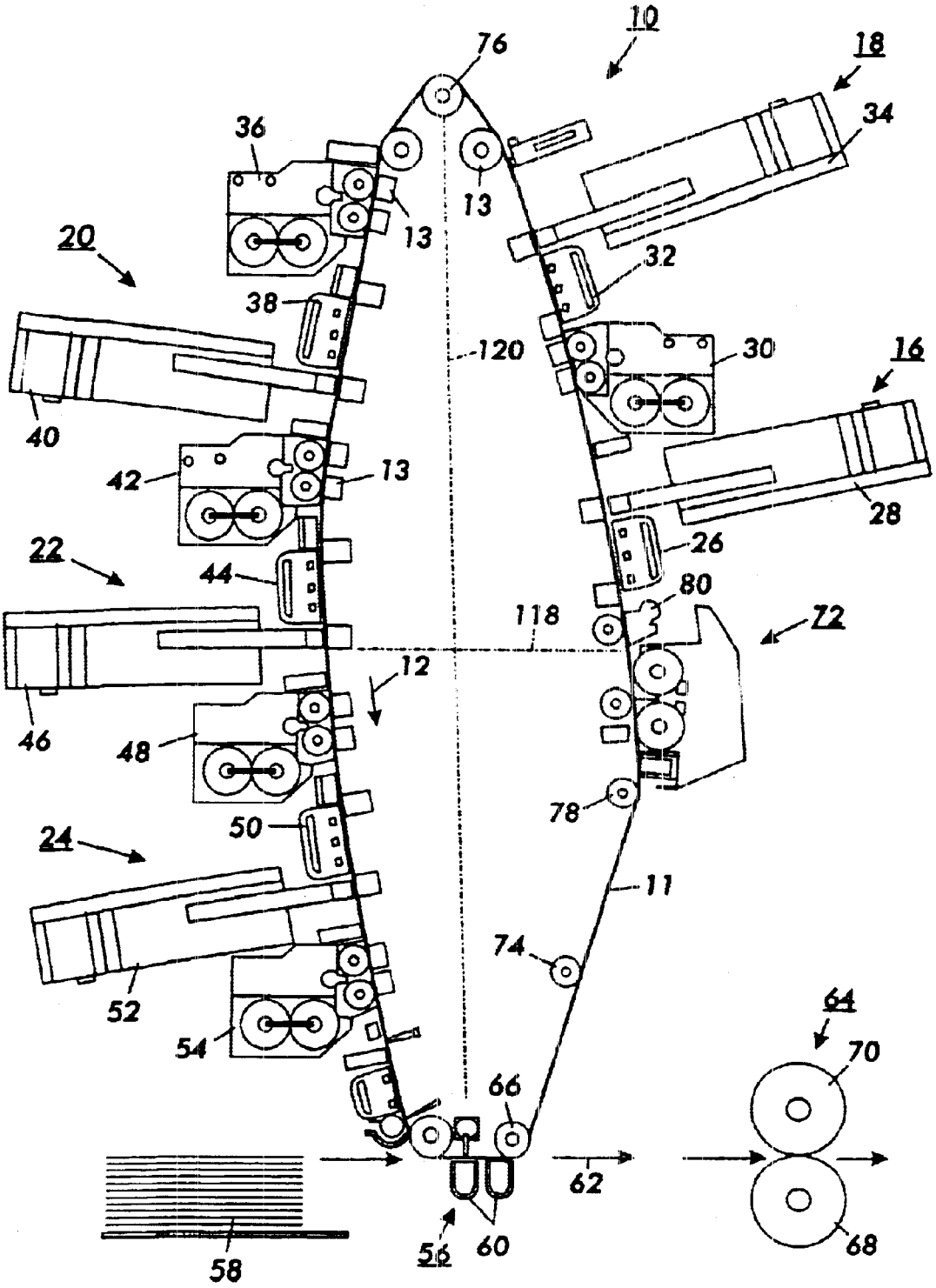
FIG. 1 is a partial schematic view of an electrophotographic printing apparatus that may be employed using the features of the present invention.

With reference to FIG. 1, there Is shown a single pass multi-color printing machine 10. This printing machine employs a photoconductive belt 11, supported by a plurality of rollers or bars, 13. Photoconductive belt 11 is arranged in a vertical orientation. The photoconductive belt 11 advances in the direction of arrow 12 to move successive portions of the external surface of photoconductive belt 11 sequentially beneath the various processing stations disposed about the path of movement thereof. The photoconductive belt 11 has a major axis 120 and a minor axis 118. The major and minor axes 120, 118 are perpendicular to one another. Photoconductive belt 11 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine 10 architecture includes five image recording stations indicated generally by the reference numerals 16, 18, 20, 22, and 24, respectively. Initially, photoconductive belt 11 passes through image recording station 16. Image recording station 16 includes a charging device and an exposure device. The charging device includes a corona generator 26 that charges the exterior surface of photoconductive belt 11 to a relatively high, substantially uniform potential. After the exterior surface of photoconductive belt 11 is charged, the charged portion thereof advances to the exposure device. The exposure device includes a raster output scanner (ROS) 28, which illuminates the charged portion of the exterior surface of photoconductive belt 11 to record a first electrostatic latent image thereon. Alternatively, a light emitting diode (LED) may be used.

The first electrostatic latent image is developed by developer unit 30. Developer unit 30 deposits toner particles of a selected color on the first electrostatic latent image. After the a highlight toner image has been developed on the exterior surface of photoconductive belt 11, photoconductive belt 11 continues to advance in the direction of arrow 12 to image recording station 18.

Image recording station 18 includes a charging device and an exposure device. The charging device includes a corona generator 32 which recharges the exterior surface of photoconductive belt 11 to a relatively high, substantially uniform potential. The exposure device includes a ROS 34 which illuminates the charged portion of the exterior surface of photoconductive belt 11 selectively to record a second electrostatic latent image thereon. This second electrostatic latent image corresponds to the region to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 11. After the magenta toner powder image has been developed on the exterior surface of photoconductive belt 11, photoconductive belt 11 continues to advance in the direction of arrow 12 to image recording station 20.

Image recording station 20 includes a charging device and an exposure device. The charging device includes corona generator 38, which recharges the exterior surface of photoconductive belt 11 to a relatively high, substantially uniform potential.

The exposure device includes ROS 40 which illuminates the charged portion of the exterior surface of photoconductive belt 11 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 11 to form a yellow toner powder image thereon. After the third electrostatic latent image has been developed with yellow toner, photoconductive belt 11 advances in the direction of arrow 12 to the next image recording station 22.

Image recording station 22 includes a charging device and an exposure device. The charging device includes a corona generator 44, which charges the exterior surface of photoconductive belt 11 to a relatively high, substantially uniform potential. The exposure device includes ROS 46, which illuminates the charged portion of the exterior surface of photoconductive belt 11 to record a fourth electrostatic latent image for development with cyan toner particles. After the fourth electrostatic latent image is recorded on the exterior surface of photoconductive belt 11, photoconductive belt 11 advances this electrostatic latent image to cyan developer unit 48.

Cyan developer unit 48 deposits cyan toner particles on the fourth electrostatic latent image. These toner particles may be partially in superimposed registration with the previously formed yellow toner powder image. After the cyan toner powder image is formed on the exterior surface of photoconductive belt 11, photoconductive belt 11 advances to the next image recording station 24.

Image recording station 24 includes a charging device and an exposure device. The charging device includes a corona generator 50 which charges the exterior surface of a photoconductive belt 11 to a relatively high, substantially uniform potential. The exposure device includes ROS 52, which illuminates the charged portion of the exterior surfaces of photoconductive belt 11 to selectively discharge those portions of the charged exterior surface of photoconductive belt 11 which are to be developed with black toner particles. The fifth electrostatic latent image, to be developed with black toner particles, is advanced to black developer unit 54.

At black developer unit 54, black toner particles are deposited on the exterior surface of photoconductive belt 11. These black toner particles form a black toner powder image which may be partially or totally in superimposed registration with the previously formed yellow and magenta toner powder images. In this way, a multi-color toner powder image is formed on the exterior surface of photoconductive belt 11. Thereafter, photoconductive belt 11 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the back side of the paper. This attracts the developed multi-color toner image from the exterior surface of photoconductive belt 11 to the sheet of paper. Stripping roller 66 contacts the interior surface of photoconductive belt 11 and provides a sufficiently sharp bend thereat so that the beam strength of the advancing paper strips from photoconductive belt 11. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. The fusing station 64 could be a roll fusing apparatus having the features of this invention as described and claimed herein. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 11. The photoconductive belt 11 moves over isolation roller 78 which isolates the cleaning operation at cleaning station 72. At cleaning station 72, the residual toner particles are removed from photoconductive belt 11. The photoconductive belt 11 then moves under spots blade 80 to also remove toner particles therefrom.

It has been determined that belt tensioning member 74, preferably a roll, which is resiliently urged into contact with the interior surface of photoconductive belt 11, has a large impact on image registration. Heretofore, tensioning of the photoconductive belt 11 was achieved by a roll located in the position of steering roll 76. In printing machines of this type, the image recording stations 16, 18, 20, 22, 24 were positioned on one side of the major axis 120, with at most there being one image recording station on the other side thereof. Thus, there would be an image recording station on one side of the major axis 120 of the photoconductive belt 11, separated by the tensioning roll, followed by four image recording stations positioned on the other side of the major axis 120 of photoconductive belt 11. It has been determined that when the height of the photoconductive belt 11 is reduced, requiring two image recording stations to be positioned on one side of the major axis 120 and three image recording stations to be positioned on the other side of the major axis 120, image-to-image registration deteriorated. This has been overcome by changing the location of the tensioning roll as to position it between stripping roller 66 and isolation roll 78 adjacent cleaning station 72. This configuration enabled image-on-image registration to be maintained at the same levels as a printing machine of the previous type, provided that the tensioning mechanism was interposed between stripping roller 66 and isolation roller 78. Tensioning roll 74 is mounted slidably on brackets. A spring resiliently urges tensioning roll 74 into contact with the interior surface of photoconductive belt 11 to maintain photoconductive belt 11 at the appropriate tension.

Figure 2:
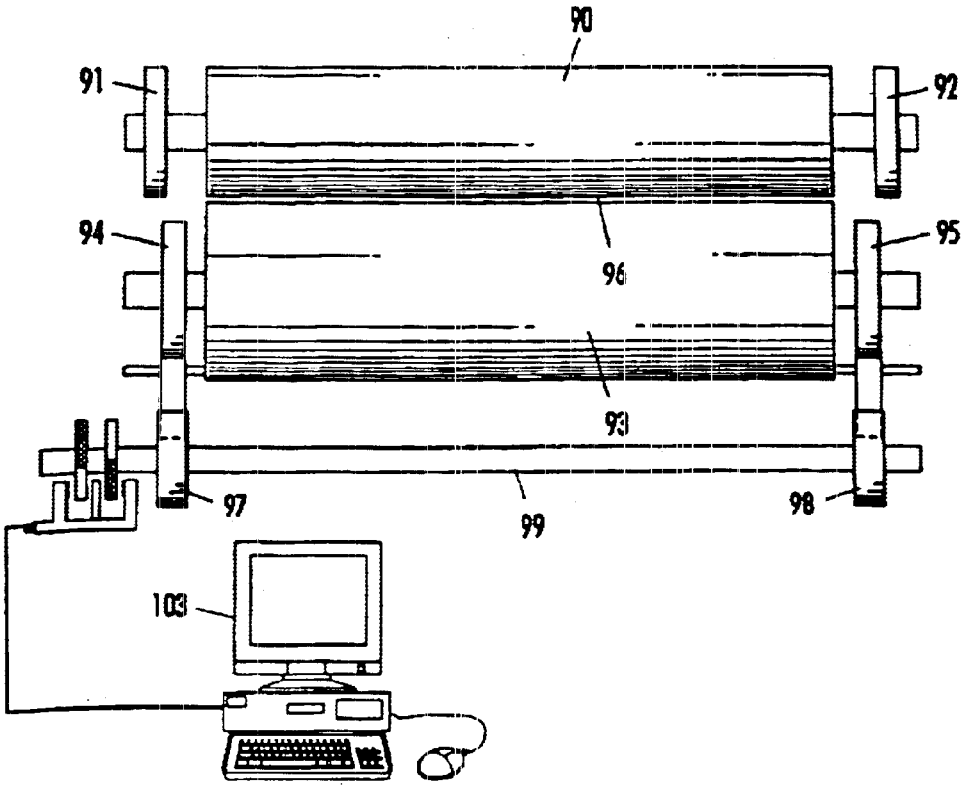
FIG. 2 is a plan front view of a roll heat and pressure roll fusing apparatus in accordance with the features to this invention.
Figure 3:
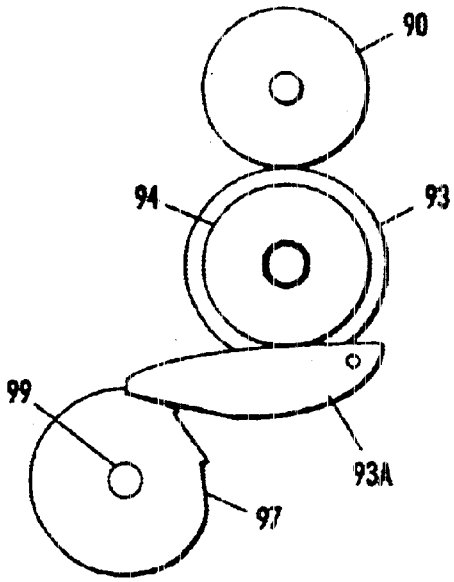
FIG. 3 is an end elevation view of part of FIG. 2.

The term "fuser nip pressure" as commonly used in xerographic related technology refers to the pressure delivered to a sheet of paper passing between heated, rubber coated rolls as illustrated in FIGS. 2 and 3. The top roll 90 is called the fuser roll. It turns in bearings 91, 92 at either end, but in basically a vertically stationary position. The bottom roll 93 is commonly referred to as the pressure roll. It is positioned at one end of a pair of load arms on either end of the roll 93, i.e. FIG. 3 load arm 93A. Upward pressure against the stationary fuser roll 90 which forms a fuser nip 96 occurs when cam followers 94 and 95 at the opposite end of the load arms ride up on the high point (lobe) of load cams 97 and 98. The load cams 97, 98 are positioned at either end of a drive shaft 99 which turns when power is supplied by a software controlled DC stepper motor (not shown). Fuser nip pressure is measured by:

1. passing a sheet of paper (previously covered with black toner) between the two rolls, 90 and 93.
2. pausing the movement of the paper briefly while cycling the load cams 97 and 98, causing brief pressure on the paper from the two heated rolls 90, 93.

3. continuing the movement of the paper into an output tray and measuring the mark left on the surface of the paper created by the re-melting of the black toner during the brief pressure.
4. the width of this mark (measured in millimeters) signifies the level of fusing pressure being applied.

Although the embodiment of the present invention as described herein is a fuser apparatus that employs a pressure roll 93, it should be understood that the features of this invention can also be used with a pressure belt 101 instead of a roll.

Current cam designs for controlling fuser nip pressure in xerographic machines employ a single high point or lobe. In turn, this design applies only one level of pressure against the fuser roll 90. Tn accordance with the features of the present invention there would be employed a plurality of additional higher and lower lobes on the load cams 97, 98, all together designed for controlling fuser nip pressure. For example, the present invention would employ two or three lobes higher and lower than currently employed designs. By employing a multi-position fuser nip load cams 97, 98 in accordance with the features of the present invention and as shown as an example in FIG. 4, there would be delivered to the fuser nip 96 (fig. 2) higher or lower fuser nip pressure which could be programmed according to the weight of the paper being processed. This can be depicted in FIG. 4 as millimeter measurements from the cam center outward to high or low points 100 and 101 respectively (lobes) positioned on the cam circumference. The steps in the load cams 97, 98 will adjust the fuser nip pressure in direct relation to the weight of the paper being fed to the fuser assembly. In accordance with the features described herein, each cam position, for example, can yield a higher nip pressure, ideally not more than one (1) nip increase per step on the load cams 97, 98. The load cams 97, 98 in turn is preferably controlled by a motor (not shown) e.g. a stepper motor, which is preferably software controlled.

All xerographic copier/printer machines generally provide a "User Interface" (UI) to permit a user to instruct the machine to produce a paper page with a desired image on it. This "UI" may be as simple as a "Start" button to press after placing an original document on a platen glass. Modern digital machines offer much more control over their image. It can be reduced or enlarged, color added in a variety of ways, and resized on different size or weight paper. In all cases, however, pressing the Start button begins a chain of events called the "xerographic process".

In the case of a xerographic machine that also serves as a printer shared by a network of computers, the "start button" is a print command on a computer screen. The purpose of the "xerographic process" is to reproduce an image from the mind of the user on a single page, or a thousand or more pages. Tn this "computer age", those images have progressed far beyond the simple text letter or memo. An office assistant with minimal training can use, for example, PowerPoint software to create exciting color rich, graphic sales presentations on a computer screen 103. They can then be printed on paper to be shared by many people. A graphic artist, using a variety of software programs, can create incredibly rich images from their imagination on a computer screen. When printed on appropriate paper as "canvas", these images can, for example, become frameable art.

Basically all imaging capability is now possible due to the ongoing development of the science of xerography. The engine for producing image on paper is the "xerographic process". Fusing (the melting of dry inks into the paper) is one of the last steps of the process. The "process" begins with pressing the Start button in the "UI", whether on the machine or computer screen. Just prior to pressing the button, the user determines the treatment to be applied to the image to be reproduced, essentially programming the machine. The image source can be an original hard-copy page placed on the machine's platen glass or created on a computer screen.

Figure 4:
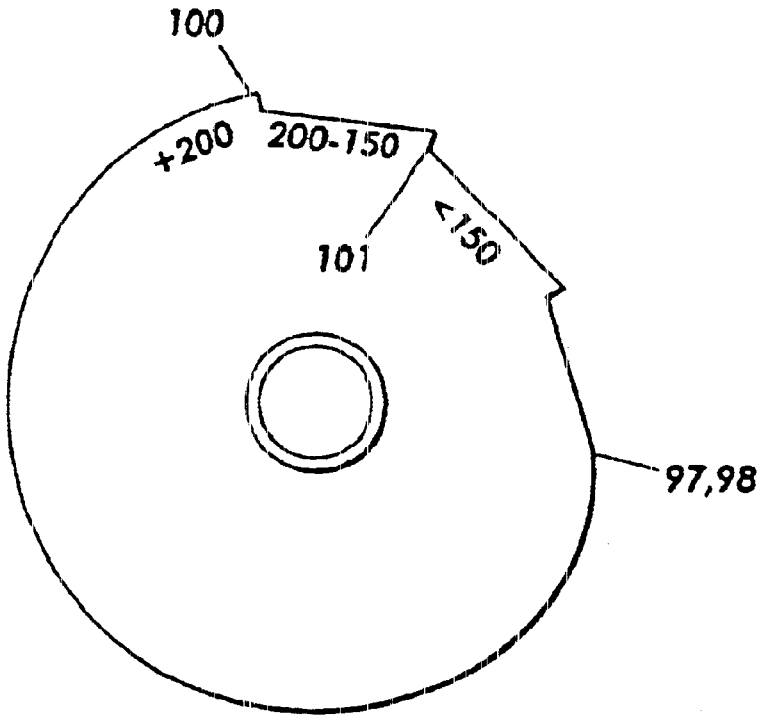
FIG. 4 is a plan sectional view of an embodiment of a cam in accordance with the features of this invention.
Figure 3A:
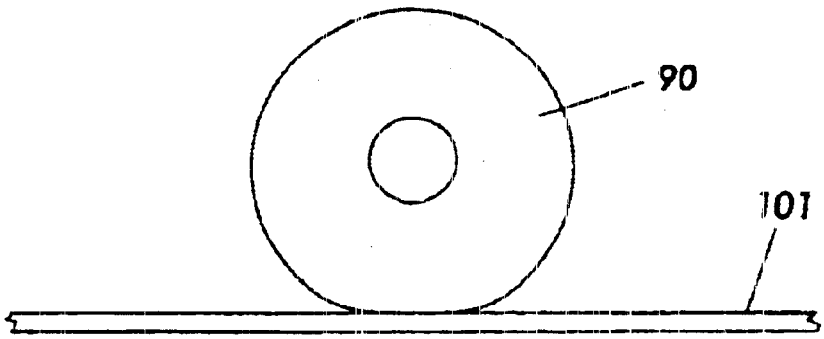
FIG. 3A is an end elevation view of part of FIG. 3 illustrating another embodiment of the invention.

When Start is initiated, a sheet of paper is moved into the "process" from a stack of paper in the machine. Dry ink particles are then deposited on the sheet using the electrostatic principles of xerography. This forms the desired image on the paper. Next, the paper moves into the fuser nip 96 (FIG. 2) formed by the two rolls 90 and 93 coming together as a result of the action of the load cams 97, 98. As the sheet moves through the fuser nip 96 with heat and pressure being applied, the dry ink particles are fused (melted) on the paper permanently fixing the image to the paper. Here is the point in the "process" where the multi-position load cams 97, 98 would be used. In programming the machine, the user chooses the type of imaging media. It can be, for example, plain paper, film, coated paper, or heavy weight paper. Each type requires a slightly different fusing treatment. For example, each type requires more or less heat or more or less pressure. The machine program enters instructions into the machine run software. The software monitors the movement of the paper through the "process". At the appropriate time, a stepper motor turns on and moves the load cams 97, 98 to the correct lobe (height) for the paper being used. Control sensors monitor the position of the load cams 97, 98 (FIG. 4). Finally the sheet of paper moves into a catch tray as the finished product.

There are also possible benefits of using such load cams 97, 98 in fuser design in terms of curl reduction, wider latitude for throughput materials, and fuser roll life improvement.

While this invention has been described in conjunction with a specific embodiment thereof, it should be evident that many alternatives and modifications can be made by those skilled in the art without departing from the invention. Accordingly, the present invention is intended to embrace all such alternatives, modifications and variances which fall within the scope of the appended claims.

What is claimed is:

1. A roll fusing apparatus for effectively heating and fusing quality toner images on various different thicknesses of substrates, the roll fusing apparatus comprising:

(a) a frame;

(b) a heated fuser roll having a first end and a second end respectively mounted to the frame;

(c) a pressure device mounted to the frame and forming a fusing nip with the heated fuser roll, the heated fuser roll and the pressure device being movable for receiving, heating and applying a nip force to toner images being moved through the fusing nip for various different thicknesses of substrates, the pressure device being elongated and having first and second cam members at spaced apart locations;

(d) a rotatable cam assembly mounted on the frame providing a varying amount of pressure to the pressure device in response to the thickness of the substrates being fed into the fusing nip of the roll fusing apparatus, the cam assembly including an elongated shaft extending between first and second ends and load cams at the first and second ends, respectively, engaged with the first and second cam follower members;

(e) a drive shaft for rotating the rotatable cam assembly; and (f) a controller for selectively moving the rotatable cam assembly in response to the thickness of the substrates.

2. A roll fusing apparatus according to claim 1 wherein motion of the drive shaft is controlled by a stepper motor.

3. A roll fusing apparatus according to claim 1 wherein the pressure device is a pressure roll.

4. A roll fusing apparatus according to claim 1 wherein the substrates are paper.

5. A roll fusing apparatus according to claim 1 including a display device connected to a microprocessor for displaying in realtime the nip force adjustments.

6. An electrostatographic reproduction machine comprising:

(a) a movable image bearing member having an image bearing surface defining a path of movement therefor;

(b) electrostatographic devices mounted along said path of movement for forming and transferring toner images onto various different types of substrates; and (c) a roll fusing apparatus for effectively heating and fusing the toner images on various different thicknesses of substrates, the roll fusing apparatus including:

(i) a frame;

(ii) a heated fuser roll having a first end and a second end respectively mounted to said frame;

(iii) a pressure device mounted to the frame and forming a fusing nip with said heated fuser roll, the heated fuser roll and the pressure device being movable for receiving, and applying a nip force to toner images being moved through the fusing nip on various different thicknesses of substrates, the pressure device being elongated and having first and second cam follower members at spaced apart locations;

(iv) a rotatable cam assembly mounted on the frame providing a varying amount of pressure to the pressure device in response to the thickness of the substrates being fed into the fusing nip of the roll fusing apparatus, the cam assembly including an elongated shaft extending between first and second ends and load cams at the first and second ends, respectively, engaged with the first and second cam follower members;

(v) a drive shaft for rotating the rotatable cam assembly; and (vi) controller for selectively moving the rotatable cam assembly in response to the thickness of the substrates.

7. A roll fusing apparatus for effectively heating and fusing quality toner images on various different thicknesses of substrates, the roll fusing apparatus comprising:

(a) a frame;

(b) a heated fuser roll having a first end and a second end respectively mounted to the frame;

c) a pressure device being a belt mounted to the frame and forming a fusing nip with the heated fuser roll, the heated fuser roll and the pressure device being movable for receiving, heating and applying a nip force to toner images being moved through the fusing nip for various different thicknesses of substrates;

(d) a rotatable cam providing a varying amount of pressure to the pressure device in response to the thickness of the substrates being fed into the fusing nip of the roll fusing apparatus;

(e) a drive shaft for rotating the rotatable cam; and (f) a controller for selectively moving the rotatable cam in response to the thickness of the substrates.

* * * * *